United States Patent [19]

Buchmann et al.

[11] 3,932,081

[45] Jan. 13, 1976

[54] EXTRUDER NOZZLE FOR SHAPING A PULP TO FORM SMOKABLE STRANDS OR FIBERS

[75] Inventors: Paul Buchmann, Basel, Switzerland; Monique Beringer, Saint Louis, France; Heinz Spörri, Birsfelden, Switzerland

[73] Assignee: Tamag/Basel AG, Basel, Switzerland

[22] Filed: Dec. 17, 1973

[21] Appl. No.: 425,134

[30] Foreign Application Priority Data

Dec. 22, 1972 Luxemburg ..... 66740

[52] U.S. Cl. ..... 425/72; 425/80; 425/83; 131/140 C

[51] Int. Cl.[2] ..... A24B 3/14; B29D 31/00

[58] Field of Search ..... 131/140 C, 269; 425/72, 425/80, 83, 382.2; 264/121

[56] References Cited

UNITED STATES PATENTS

| | | | |
|---|---|---|---|
| 2,437,263 | 3/1948 | Manning | 425/83 X |
| 2,965,925 | 12/1960 | Dietzsch | 425/382.2 X |
| 3,080,611 | 3/1963 | Jarrett et al. | 425/72 X |
| 3,203,432 | 8/1965 | Green et al. | 131/140 C |
| 3,337,669 | 8/1967 | Shannon et al. | 264/121 |
| 3,502,763 | 3/1970 | Hartmann | 425/72 X |
| 3,806,289 | 4/1974 | Schwarz | 425/72 |

FOREIGN PATENTS OR APPLICATIONS

| | | | |
|---|---|---|---|
| 756,045 | 8/1956 | United Kingdom | 425/72 |

*Primary Examiner*—R. Spencer Annear
*Attorney, Agent, or Firm*—Karl F. Ross; Herbert Dubno

[57] ABSTRACT

An extruder nozzle for an apparatus for producing tobacco fiber from a paste, pulp, mash or slurry of comminuted botanics, which may or may not contain tobacco, binders, plasticizers and organic and inorganic salts, comprises a nozzle surface formed with a multiplicity of orifices through which strands of the dryable composition are extruded. Distributed among the orifices are openings for a compressed gas, e.g. compressed air, which passes along the fibers in the direction of extrusion thereof and hence applies an entraining force to the strands tending to break them off into fibers.

10 Claims, 6 Drawing Figures

EXTRUDER NOZZLE FOR SHAPING A PULP TO FORM SMOKABLE STRANDS OR FIBERS

FIELD OF THE INVENTION

The invention relates to an extruder nozzle for shaping a mash, paste or slurry of a smokeable composition pulp, introduced under pressure, into smoking fibers by extruding the pulp through several pulp outlet openings or orifices formed side by side in a nozzle mouthpiece directed in a common jet region.

BACKGROUND OF THE INVENTION

In the commonly assigned copending application Ser. No. 194,654, filed Nov. 1, 1971, (now U.S. Pat. No. 3,820,548) there is described a composition for the production of tobacco-like smokeable materials in which tobacco and non-tobacco botanicals, plasticizers, binders or film forming materials, flavoring agents and organic or inorganic salts and fillers are combined with water to produce a slurry, paste or mash. The latter, can be shaped into foils by casting upon a surface and, when dried, the foil can be subdivided into strands and the strands subdivided, in turn, to produce fibers of a convenient length. The composition is characterized by pleasant smoking characteristics as pipe, cigarette and cigar tobacco and when, in the following description, reference is made to a tobacco-like composition it is to be understood that the composition described in the aforementioned copending application may be employed.

If herein and hereinafter there is mention of tobacco pulp, then by this should be understood a pulp containing natural tobacco and/or tobacco substitutes which, by drying, can be molded into a smokeable, regenerated tobacco or tobacco substitute.

Extruder nozzles of the kind referred to above serve the purpose of forming the pulp into fiber form, so that the latter, when set by drying, may be processed directly into smokeable materials.

In one known nozzle of the kind referred to above, five pulp outlet openings are located side by side, from each of which a continuous tobacco strand issues which by drying sets into an extremely long tobacco fiber which can then be cut into required lengths.

OBJECTS OF THE INVENTION

It is the principal object of the present invention to provide an improved system for making tobacco fibers from an extrudable and dryable paste, pulp, mash or slurry of a tobacco-containing or tobacco-free composition of the character previously described.

It is an another object of the invention to provide a method and an apparatus for the production of tobacco-like fibers whereby multiple preparation operations characterizing earlier systems can be obviated.

It is an object of the invention to avoid the cutting operation and to produce from the start tobacco fibers of the required length.

SUMMARY OF THE INVENTION

The present invention is based upon our discovery that, when a smokeable extrudable composition of the character previously described is forced through a multiplicity of orifices to form discrete and separate strands of a tobacco-containing or tobacco-free composition and a substantially constant force is applied to the strands immediately as they extrude from the orifices, it is possible to automatically break up each strand into individual fibers of a convenient length whereby the comminution technique of the prior art can be avoided. We have further discovered that the necessary force can most advantageously be applied by directing at the nozzle surface a flow of gas in the same direction as that in which the strands are extruded, i.e. by providing the nozzle surface with openings interspersed with the extrusion orifices and from which a compressed gas, preferably compressed air, is discharged.

It appears that the codirectional flow of air and the extruded material, where the air has a higher velocity than the extruded material, results in a frictional entrainment of the portion of the strand emerging from the extrusion orifices and tends to draw the strand away from the orifices with a force which increases as the length of the extruded portion exposed to the air stream increases. At a certain point, this force exceeds the cohesive force and the exposed length of strand ruptures to separate a tobacco-like fiber from the extruding strand.

The invention provides that between the pulp outlet orifices in the nozzle mouthpiece, compressed-gas openings are provided which are connected to a compressed-gas supply system. Thus the fibers at a critical point in their formation are immediately surrounded by the gas flow and hence at least externally dried so that they retain the elongate form obtained by the extrusion from the nozzle. They are also carried away, stretched by the accompanying stream of air and prevented from adhering to the adjacent fibers. By the gas stream surrounding the fibers formed, the fibers are torn from the nozzle upon having attained a certain length and the operating conditions may be readily chosen so that the fibers are formed of the required length from the start.

The moment of break-away may also be predetermined in that the gas stream surrounding the fibers formed is pulsed and/or the pressure load at which the pulp is supplied to this extruder nozzle is pulsed.

According to another feature of this invention, the fibers torn away from the respective strands are entrained with the gas stream along a path whereby heavier fibers are separated from lighter fibers and the resulting classification represents a classification by length. The fibers of different size can be processed independently.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
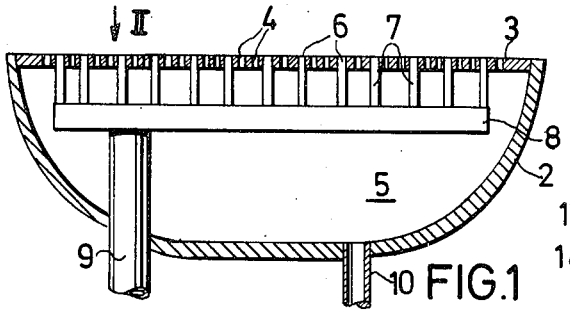
FIG. 1 shows an extruder nozzle according to the invention in cross-section.

In accordance with FIG. 1, the numeral 1 generally denotes the extruder nozzle which consists of a hemispherical hollow body 2, the flat end face of which is formed as nozzle mouthpiece 3 and provided with a plurality of openings. The openings comprise pulp outlet orifices 4 which lead directly into the interior 5 of the hollow body 2, and compressed-air openings 6 which are connected by pipe stubs 7 to a compressed-air ring conduit 8 or manifold located in the interior of the hollow body. A compressed-air-supply pipe 9 communicates with the ring conduit 8 and is led in sealed from the outside where it is connected to a compressed-air-supply system.

A pulp supply pipe 10 is connected between the pressure side of a pump, not shown, and the interior 5; the pump forces tobacco pulp under pressure from a storage container via the pulp supply pipe 10 into the interior 5 and extrudes the pulp out of the pulp outlet orifices 4. During operation, the pulp in form of soft threads or strands is discharged through the pulp outlet orifices because of the pressure load. These threads or strands arrive in the region of action of the compressed air flow, which is generated from the compressed-air openings 6, and are torn off thereby as soon as they have reached a certain length which depends upon the operating conditions, the consistency of the tobacco pulp and the geometric configuration of the nozzle mouthpiece 3.

Figure 2:
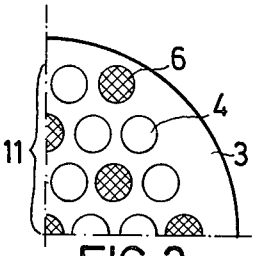
FIG. 2 is a plan view in section taken in the direction of the arrow II in FIG. 1.

To ensure that all the tobacco fibers and strands being formed are engaged by the co-directionally flowing compressed air and are also torn off at substantially uniform length, the compressed air openings 6 are spread uniformly below the pulp outlet openings. All these openings, as shown in FIG. 2, are circular. In FIG. 2 for the sake of clarity, the pulp outlet orifices 4, are left open while the compressed-air openings 6 are shown diagonally hatched. The openings 4, 6 are circular and all of equal diameter and are located at the corners and in the centre of regular hexagons.

Figure 5:
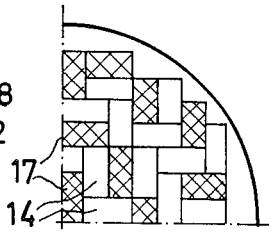
FIGS. 3 to 5 are sectional views similar to FIG. 2 and illustrating further embodiments.
Figure 3:
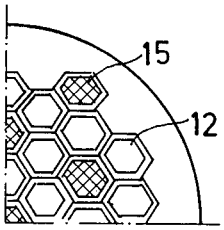
Figure 4:
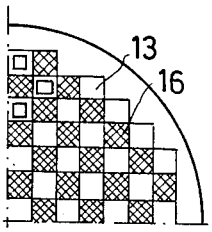

In FIGS. 3 to 5, the pulp outlet openings 12, 13, 14 are shown open while the compressed-air outlets are denoted by 15, 16 and 17 respectively and are shown diagonally hatched. In FIG. 3, the openings 12, 15 have a regular hexagonal cross-section. According to FIG. 4, the openings 13, 16 are squares and according to FIG. 5 the openings 14, 17 are rectangles.

The pulp outlet openings 4, 12, 13 and 14 and the compressed-air openings 6, 15, 16 and 17 respectively are evenly spread over the outlet surface 11 of the nozzle mouthpiece concerned so that each pulp outlet opening is at least directly adjacent to a compressed-air opening.

In the embodiments of FIGS. 2, 3 and 4 all the openings mutually are of the same size; however the compressed air openings can be smaller than the pulp outlet openings.

Figure 6:
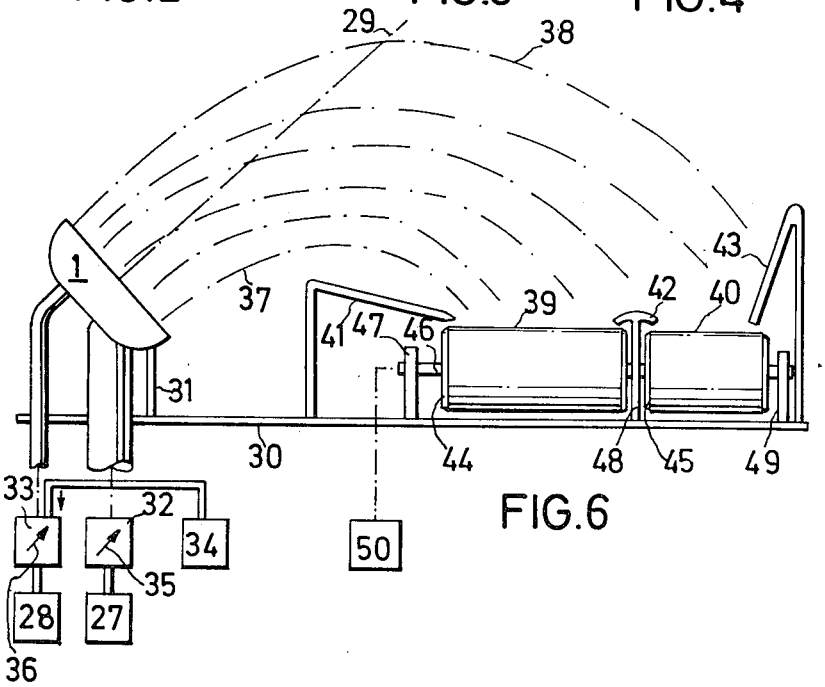
FIG. 6 is a diagrammatic elevational view of an apparatus for moulding tobacco pulp into tobacco fibers having an extruder nozzle according to the invention.

In FIG. 6, 30 denotes a machine frame on which the extruder nozzle 1 is mounted by means of a holder 31, the compressed air supply pipe 9 of which leads to a compressed air supply system 32, while the pulp supply pipe 10 via a pump 33 communicates with a tobacco pulp reservoir 34. The arrows 35 and 36 indicate that the compressed air pressure acting on the extruder nozzle 1 or that the pressure on the tobacco pulp is adjustable from the outside by suitable handles.

The compressed air openings 6 and the pulp outlet openings 4 in the extruder nozzle are directed in the same jet cone, the median axis of which is denoted by 29.

During operation, the tobacco fibers which are still soft and dried only externally, are torn-off by the compressed air flow and at first forcibly carried along by the compressed air flow, hence in the direction of the axis 29, but then, due to their gravity drop downwards so that they substantially describe an orbit as represented by the dot-dash lines 37 and 38. This orbit is directed to two conveyor belts which are formed to convey at right angles to the direction of the axis 29, namely in the direction of the drawing plane of FIG. 6. The tobacco fibers which do not travel very far, i.e. the ligher shorter ones, drop onto the first conveyor belt 39, while the tobacco fibers which travel further, i.e. the heavy larger ones, drop onto the second conveyor belt 40. Between and on both sides of the conveyor belts, sliding plates 41, 42, 43 are located which are secured to the frame 30 and serve to conduct the overshooting and undershooting tobacco fibers onto the conveyor belts thereon. The two conveyor belts are guided over rollers 44, 45, the common shaft 46 of which being mounted in end plates 47 to 49 on the frame and are driven by a motor 50. The tobacco fibers, dried externally, arrive on the conveyor belts where they are further dried until sufficiently set. For this purpose, heating and ventilating devices may be provided which are directed against the fibers to be dried.

The numerals 27 and 28 denote two impulse generators which periodically superimpose pressure impulses to the pressure produced by the compressed air supply system 32 and the pump 33 respectively. Such pressure surfaces determine the tearingoff moment forming at the pulp outlet openings 4. A single impulse generator 27 or 28 suffices for this purpose. It is also possible to dispense entirely with the impulse generators 27 and 28 or to switch these off; statistically the fibers formed tear-off when reaching a length dependent upon operating conditions, the pulp consistencies and the geometry of the nozzle.

The invention may be used to produce smokeable fibers of tobacco or tobacco wastes and can use plants which are not tobacco plants — i.e. so-called non-tobacco plants.

SPECIFIC EXAMPLES

Example 1

1000 Grams crushed wheat, 1000 grams wheat straw, 1000 grams rice straw, 1000 grams oat straw, 500 grams coconut shells with fibers and 500 grams cacao shells are ground in a dry state and suspended with 15 liters of water and the suspension is milled in a wet state at a maximum temperature of 60°C.

Into the suspension so formed the following components are charged: 50 grams magnesium formate, 300 grams tartaric acid, 100 grams potassium nitrate, 400 grams diammonium hydrogen phosphate, 7.5 grams vanillin, 400 grams calcium carbonate, 400 grams liquid paraffin, 900 grams NaCMC (sodium carboxymethylcellulose), 200 grams raw pectin, 150 grams 40 percent glyoxal, 100 grams glycerine, 650 grams diethylene glycol, 850 grams fruit concentrate, 500 grams invert sugar and 50 grams coffee bean residue and the mixture so formed is kneaded into a homogeneous pulp in a kneading machine.

The pulp produced in this manner is charged into a pulp storage container 34 in accordance with FIG. 6 and extruded into fibers as described in connection therewith.

Example 2

5000 Grams natural tobacco wastes are ground in a dry state, suspended with 15 liters of water and the suspension ground in a wet state at a maximum temperature of 60°C.

Into the suspension so formed the following components are charged: 50 grams magnesium formate, 500 grams NaCMC (sodium carboxymethylcellulose), 200 grams glycerine and 100 grams 40 percent glyoxal and the mixture so formed is kneaded into a homogenous pulp in a kneading machine.

The pulp so produced is charged into a pulp storage container in accordance with FIG. 6 and extruded into fibers as described in connection therewith.

All weight data relate to the pulp components with their natural water and water of crystallization content respectively.

We claim:

1. In an apparatus for the formation of smokeable fibers the improvement which comprises an extruder nozzle having a nozzle surface formed with a plurality of extrusion orifices and interspersed with said orifices; a multiplicity of gas-outlet openings interspersed with said orifices and coplanar therewith, a plurality of said openings surrounding each orifice; means for forcing an extrudable smokeable composition through said orifices to form discrete strands; and means for supplying a compressed gas to said openings to produce a gas flow codirectionally with and along said strands breaking the same into fibers by tearing said strands from said orifices in the direction in which the strands are extruded.

2. The improvement defined in claim 1 wherein said orifices have a jet region and said openings are trained on said jet region.

3. The improvement defined in claim 2 wherein said openings are located side by side with said orifices.

4. The improvement defined in claim 3 wherein said orifices are uniformly distributed over said surface and said openings are uniformly distributed over said surface.

5. The improvement defined in claim 4 wherein said nozzle further comprises means defining a chamber bounded by a wall forming said surface and communicating with said orifices, said composition being forced into said chamber, said means for supplying compressed gas to said openings including a manifold received in said chamber.

6. The improvement defined in claim 5 wherein said means for supplying compressed gas to said openings includes pulsing means for applying pressure pulses to said gas.

7. The improvement defined in claim 5 wherein the means for supplying said composition through said chamber includes pulsing means for periodically pulsing the pressure of the extruding composition.

8. The improvement defined in claim 5 wherein the gas flowing from said openings entrains said fibers along a trajectory, further comprising means for collecting fiber at locations offset along said trajectory in accordance with the fiber length.

9. The improvement defined in claim 5 wherein said orifices and said openings are of circular configuration.

10. The improvement defined in claim 5 wherein said orifices and said openings are of polygonal configuration.

* * * * *